United States Patent [19]

Gernert

[11] 4,316,953

[45] Feb. 23, 1982

[54] PHOTOGRAPHIC EMULSION CONTAINING A STABILIZER, A PROCESS FOR ITS PRODUCTION AND PHOTOGRAPHIC MATERIALS

[75] Inventor: Herbert Gernert, Munich, Fed. Rep. of Germany

[73] Assignee: AGFA-Gevaert Aktiengesellschaft, Leverkusen, Fed. Rep. of Germany

[21] Appl. No.: 173,636

[22] Filed: Jul. 30, 1980

[30] Foreign Application Priority Data

Aug. 4, 1979 [DE] Fed. Rep. of Germany ..... 2931691

[51] Int. Cl.[3] ..... G03C 1/31

[52] U.S. Cl. ..... 430/569; 430/612; 430/936; 430/611

[58] Field of Search ..... 430/611, 612, 936, 490, 430/569

[56] References Cited

U.S. PATENT DOCUMENTS

| | | | |
|---|---|---|---|
| 2,363,777 | 11/1944 | Dowing | 430/490 |
| 2,449,153 | 9/1948 | Urbach | 430/603 |
| 2,955,036 | 10/1960 | Dersch et al. | 430/611 |
| 3,043,696 | 7/1962 | Herz et al. | 430/611 |
| 3,556,797 | 1/1971 | Pattijn et al. | 430/612 |

*Primary Examiner*—Richard L. Schilling
*Assistant Examiner*—John L. Goodrow
*Attorney, Agent, or Firm*—Connolly and Hutz

[57] ABSTRACT

Photographic emulsions are stabilized by a complex of cobalt with an aminocarboxylic acid.

6 Claims, No Drawings

PHOTOGRAPHIC EMULSION CONTAINING A STABILIZER, A PROCESS FOR ITS PRODUCTION AND PHOTOGRAPHIC MATERIALS

This invention relates to a silver halide emulsion which is stabilised against the formation of fog by the addition of at least one stabiliser. The invention also relates to a process for producing this emulsion and to photographic materials.

It is known that materials containing photosensitive, in particular chemically sensitised, silver halide emulsions have a tendency to form fogs produced by nuclei which can be developed without exposure. This fogging occurs in particular in the event of prolonged storage, particularly at elevated temperature and in the presence of atmospheric moisture.

It is known that so-called anti-fogging agents or stabilisers can be added to photographic silver halide emulsions in order to improve their stability. The stability of a photographic material is understood to be inter alia a minimal increase in fogging during storage and minimal deviations in the density of the stored material in comparison with its fresh state. Silver bromide iodide emulsions in particular are often observed to undergo an increase in sensitivity during storage at elevated temperature, resulting in an increase in the fog level. This property is also in evidence under normal storage conditions and results in a continuous change in density during storage which is particularly troublesome in the case of materials of the type used for reprographic work where the stability of the material has to satisfy stringent requirements. A stabilising effect is shown for example by heterocyclic mercapto compounds, for example of the type described in German Auslegeschrift No. 1,183,371 and in German Offenlegungsschriften Nos. 2,308,530 and 1,622,271.

However, these stabilisers have the disadvantage that, in effective concentrations, they generally reduce the sensitivity of the stabilised emulsion, thereby impairing its usefulness. The gradation of the emulsion can also be adversely affected by these stabilisers.

Stabilisers have to meet a variety of requirements, particularly in regard to their interaction with other photographic additives and in view of the multiplicity of photographic reproduction processes and of the photographic materials used in them. These various requirements are not satisfied by the known stabilisers.

An object of the present invention is inter alia to find new stabilisers.

A photographic silver halide emulsion has now been found which contains at least one complex of cobalt with an aminocarboxylic acid corresponding to the following formula:

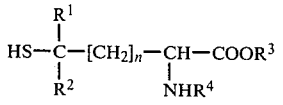

I in which $R^1$ represents hydrogen or an alkyl, aryl, aralkyl or acyl group;

$R^2$ represents an alkyl, aryl, aralkyl or acyl group;

$R^3$ represents hydrogen or a cation;

$R^4$ represents hydrogen or an alkyl or acyl group;

n=0 or an integer and/or $R^1$ together with $R^2$ represents the atoms required to complete a ring preferably a carbocyclic ring, more particularly a cyclopentyl or cyclohexyl ring.

Complexes such as these may be produced very easily by reacting a water-soluble cobalt salt with a compound corresponding to formula I. The production of complexes such as these is moreover known from the literature. Such complexes are preferred in which the molar ratio of cobalt and the amino carboxylic acid is 1:1, 1:2 or 1:3; in these complexes the cobalt ion is preferably bivalent or trivalent.

The present invention also relates to a process for the production of photographic emulsions by precipitation in a protective colloid and adding to the emulsion at least one of the compounds suitable for use in accordance with the invention. The invention also relates to a photographic material comprising a substrate, at least one silver halide emulsion layer and, optionally, further layers, at least one of the layers containing one of the compounds suitable for use in accordance with the invention.

The compound used in accordance with the invention is preferably contained in a silver halide emulsion layer.

The above-mentioned alkyl, aryl and acyl groups may even be substituted by substituents which do not produce any adverse effects in photographic materials.

Preferred alkyl radicals ($R^1$, $R^2$ and $R^4$) contain from 1 to 4 carbon atoms, for example methyl and butyl. Methyl and ethyl are particularly preferred.

Preferred aryl groups ($R^1$ and $R^2$) contain from 6 to 12 carbon atoms, particularly phenyl.

Preferred aralkyl groups ($R^1$ and $R^2$) contain 1 or 2 carbon atoms in the aliphatic portion and from 6 to 12 carbon atoms in the aromatic portion, for example benzyl.

Acyl radicals ($R^1$ and $R^2$) are understood in particular to be those which are derived from aliphatic or aromatic carboxylic or sulphonic acids, including carbonic acid mono esters, carbamic acids or sulphamic acids. Examples of acyl radicals such as these are formyl, benzoyl, phenyl carbamoyl, ethoxy carbonyl. Acetyl is particularly preferred.

$R^3$ preferably represents hydrogen, ammonium or an alkali metal, in particular, sodium or potassium.

n is preferably 0, 1 or 2, particularly 0.

Compounds in which n=0 and $R^4$ represents hydrogen are particularly preferred.

Examples of compounds suitable for use in accordance with the invention are shown in Table 1 below, their production being known from the literature.

TABLE 1

| Compound No. | $R^1$ | $R^2$ | $R^3$ | $R^4$ | n |
|---|---|---|---|---|---|
| 1.1 | $CH_3$— | $CH_3$— | —H | —H | 0 |
| 1.2 | $CH_3$— | —H | —H | —H | 1 |
| 1.3 | $C_2H_5$— | —H | —H | —H | 0 |
| 1.4 | $C_2H_5$— | $C_2H_5$— | —H | —H | 0 |
| 1.5 | $CH_3$— | $CH_3$— | —H | —H | 1 |
| 1.6 | —$[CH_2]_4$— | | —H | —H | 1 |
| 1.7 | $CH_3$— | $CH_3$— | —H | $CH_3$— | 0 |
| 1.8 | —$[CH_2]_5$— | | —H | —H | 1 |
| 1.9 | $CH_3$— | $CH_3$— | —H | —$COCH_3$ | 0 |

The production of the compounds used in accordance with the invention is described by way of example in the following with reference to the production of cobalt complexes of penicillamine.

Variant 2.1

0.5 g of penicillamine are dissolved in 100 ml of water and the resulting solution added to 100 ml of a 1% solution of $CO(NO_3)_2.6H_2O$.

Variant 2.2

1.0 g of penicillamine are dissolved in 100 ml of water and the resulting solution is added to 100 ml of a 1% solution of $CO(NO_3)_2.6H_2O$.

Variant 2.3

2.0 g of penicillamine are dissolved in 100 ml of water and the resulting solution is added to 100 ml of a 1% solution of $CO(NO_3)_2.6H_2O$.

The stabilisers used in accordance with the invention may be introduced into at least one layer or intermediate layer of a photographic material which is in water-permeable relationship with the emulsion layer to be stabilised. They may be added in particular to the photosensitive silver halide emulsions, for example to the final casting solution, or alternatively may even be applied to the photographic material together with the last protective layer. The quantity of stabilisers used may vary within wide limits. It depends upon the type of emulsion and upon the effect required. The required effects are generally obtained with quantities of from 0.05 mg to 100 mg and, more particularly, with quantities of from 0.05 mg to 2 mg per mole of silver halide.

In general, fogging is reduced and density stabilised for constant sensitivity in particular with from 0.1 to 2 mg of the cobalt chelate compound per mole of silver halide. Larger quantities of the cobalt chelate compound desensitise and stabilise photographic silver halide emulsions and are used in particular where an emulsion is to be desensitised to bright darkroom light. Depending on the required effect, it is necessary in this case to use quantities of more than 2 mg of the cobalt chelate compound per mole of silver halide, quantities of from 2 mg to 100 mg per mole of silver halide generally being sufficient.

This is because, for processing in bright darkroom light, it is advisable to desensitise the photographic material to a considerable extent which may be done by adding relatively large quantities of the compounds used in accordance with the invention. Thus, it is possible for example with a quantity of approximately 30 mg of the cobalt chelate compound of penicillamine to obtain a reduction in sensitivity of approximately 1.3 log it, making it possible for the material to be processed in considerably brighter darkroom light. This application is of interest in the case of photographic materials for copying processes where correspondingly powerful light sources are available and where it is not possible to change over to fine-grained, non-sensitive emulsions because they do not produce the flat gradation required.

The optimal quantity for each emulsion or each photographic material may readily be determined by the usual tests.

The stabilisers used in accordance with the invention may be added to photosensitive silver halide emulsions at basically any time during the production or further processing of the emulsion. In one preferred embodiment, the stabilisers used are added to the silver halide emulsion during the chemical ripening process. In another preferred embodiment, they are added after chemical ripening, preferably to the final casting solution.

In one preferred embodiment, the compounds used in accordance with the invention are employed in conjunction with free, i.e. non-complexed, compounds corresponding to formula I.

In this way, it is possible to increase sensitivity and also stability whilst, at the same time, reducing the fog level. The simultaneous use of the cobalt complex of penicillamine with free penicillamine is particularly suitable.

The stabilisers used in accordance with the invention may be employed in the usual photosensitive photographic materials which are suitable for the production of black-and-white images, for example black-and-white photographic or copying materials or reversal materials. In addition, colour couplers may be present in the material without impairing the stabilising effect.

The usual silver halide emulsions which may consist of pure silver halides or of mixtures thereof are suitable for the purposes of the invention. For example, the silver halide grains may consist of silver chloride, silver bromide, silver iodide, silver chloro bromide, silver chloro iodide, silver bromo iodide and silver chloro bromo iodide. The present invention is particularly suitable for silver bromo iodide emulsions containing up to 8 mole percent of iodide.

The emulsions may be chemically sensitised, for example by the addition during chemical ripening of sulphur-containing compounds, for example allyl isothiocyanate, allyl thiourea, sodium thiosulphate and the like. Other suitable chemical sensitisers are reducing agents, for example the tin compounds described in Belgian Pat. Nos. 493,464 and 568,687, also polyamines, such as diethylene triamine, or aminomethyl sulphinic acid derivatives, for example according to Belgian Pat. No. 547,323.

Other suitable chemical sensitisers are noble metals and nobel metal compounds, such as gold, platinum, palladium, iridium, ruthenium or rhodium. This method of chemical sensitisation is described in the Article by R. Koslowsky in Z. Wiss. Phot. 46 (1951), pages 65 to 72.

The emulsions may also be sensitised with polyalkylene oxide derivatives, for example with polyethylene oxide having a molecular weight of from 1000 to 20,000, and with condensation products of alkylene oxides and aliphatic alcohols, glycols, cyclic dehydration products of hexitols, with alkyl-substituted phenols, aliphatic carboxylic acids, aliphatic amines, aliphatic diamines and amides. The condensation products have a molecular weight of at least 700 and preferably of more than 1000. In order to obtain special effects, these sensitisers may of course be combined, as described in Belgian Pat. No. 537,278 and in British Pat. No. 727,982.

The emulsions are preferably not optically sensitised or are ortho-sensitised with the usual dyes.

The emulsions may be hardened in the usual way, for example with formaldehyde or halogen-substituted aldehydes which contain a carboxyl group, such as mucobromic acid, diketones, methane sulphonic acid esters and dialdehydes. In addition, the photographic layers may be hardened with epoxide, heterocyclic ethylene imine or acryloyl hardeners. Examples of hardeners such as these are described, for example, in German Offenlegungsschrift No. 2,263,602 or in British Pat. No. 1,266,655.

In addition, the layers may also be hardened by the process described in German Offenlegungsschrift No.

2,218,009 in order to obtain photographic materials which are suitable for high-temperature processing.

The photographic layers or the colour photographic multilayer materials may also be hardened with diazine, triazine or 1,2-dihydroquinoline hardeners, as described in British Pat. Nos. 1,193,290; 1,251,091; 1,306,544 and 1,266,655; French Pat. No. 71 02 716 or German Offenlegungsschrift No. 2,332,317. Examples of hardeners such as these are diazine derivatives containing alkyl or aryl sulphonyl groups, derivatives of hydrogenated diazines or triazines, such as for example 1,3,5-hexahydrotriazine, fluorine-substituted diazine derivatives such as, for example, fluoropyrimidine, esters of disubstituted 1,2-dihydroquinoline- or 1,2-dihydroisoquinoline-N-carboxylic acids. It is also possible to use vinyl sulphonic acid hardeners, carbodiimide or carbamoyl hardeners of the type described, for example, in German Offenlegungsschriften Nos. 2,263,602; 2,225,230 and 1,808,685; French Pat. No. 1,491,807; German Pat. No. 872,153 and East German Pat. No. 7218. Other suitable hardeners are described, for example, in British Pat. No. 1,268,550.

The present invention may be used both for the production of black-and-white images and also for the production of colour photographic images. Colour photographic images may be obtained for example by the known principle of chromogenic development in the presence of colour couplers which react with the oxidation product of dye-producing p-phenylene diamine developers to form dyes. The colour couplers may be incorporated into at least one layer of the photographic material, for example into at least one silver halide layer. Suitable colour couplers are described for example in the Article by W. Pelz entitled "Colour Couplers" in "Mitteilungen aus den Forschungslaboratorien der Agfa, Leverkusen/München," Vol. III (1961) and by K. Venkataraman in "The Chemistry of Synthetic Dyes," Vol. 4, pages 341–387, Academic Press (1971).

The emulsions may be applied to the usual support layers, for example to substrates of cellulose esters, such as cellulose acetate or cellulose acetobutyrate, also polyesters, particularly polyethylene terephthalate, or polycarbonates, particularly based on bis-phenylol propane. Other suitable substrates are paper substrates which may contain water-impermeable polyolefine layers, for example of polyethylene or polypropylene, and also glass or metal substrates.

For black-and-white development, it is possible to use the known black-and-white developer compounds such as, for example, hydroxybenzenes and 3-pyrazolidones.

The usual colour developer substances may be used for producing colour images.

EXAMPLE 1

1.2 g of triazaindolizine per mole of silver halide are added to a chemically-ripened silver bromo iodide emulsion sensitised with gold and thiosulphate (medium sensitivity; iodide content 2.5 mole percent). Quantities of 0, 2, 4 and 8 ml per mole of silver halide of the 1:100 diluted solution of the Co-chelate compound according to variants 2.1, 2.2 and 2.3 were added to this emulsion which was adjusted to a silver content of 170 g of $AgNO_3$ per liter and to a gelatin content of 15%. After stirring for 10 minutes at 40° C., 20 ml of a 5% saponin solution were added. For hardening, 35 ml of a 2% formalin solution per mole of silver halide were added to the emulsion shortly before casting.

The protective layer contained 5% of a suitable protective layer gelatin, 40 ml of a 5% saponin solution and 40 ml of a 5% sucrose monolaurate solution per liter of protective layer solution.

The emulsion ready for casting was applied to webs with a silver coating of 9.5 g of $AgNO_3/m^2$ and a protective layer 1.8μ thick on an antihalo-backed polyester support, followed by drying. The film thus formed had a total layer thickness of 12μ.

Thereafter, sensitometer strips of the fresh film and of the film stored for 72 hours at 60° C. were subjected to 1/1000 sec. exposure in a short-time sensitometer and further processed in the usual way.

The developer contained:

KBr 3.4 g
hydroquinone 8 g
1-phenyl pyrazolidone 0.3 g
$K_2S_2O_5$ 18.5 mg
KOH (40%) 20 ml
$H_3BO_3$ 2.5 g
$K_2CO_3$ 15 g made up with water to 1 liter. The development time at 26° C. was 2 minutes 30 seconds. The sensitometric values of the samples are shown in Table 1.

TABLE 1

| Sample | Addition of the compound according to variant | Quantity added (ml of Co-chelate compound of penicillamine 1:100/mole AgX) |
|---|---|---|
| 1 | no addition | — |
| 2 | 2.1 | 2 |
| 3 | 2.1 | 4 |
| 4 | 2.1 | 8 |
| 5 | 2.2 | 2 |
| 6 | 2.2 | 4 |
| 7 | 2.2 | 8 |
| 8 | 2.3 | 2 |
| 9 | 2.3 | 4 |
| 10 | 2.3 | 8 |

| | | | | 3 days in a heating cabinet at 60° C. | |
|---|---|---|---|---|---|
| Sample | Fog | γ | E | fog | Δ log It |
| 1 | 0.05 | 1.42 | 100 | 0.16 | +0.48 |
| 2 | 0.05 | 1.45 | 100 | 0.10 | +0.38 |
| 3 | 0.04 | 1.42 | 95 | 0.07 | +0.32 |
| 4 | 0.04 | 1.46 | 95 | 0.06 | +0.32 |
| 5 | 0.05 | 1.42 | 105 | 0.07 | +0.26 |
| 6 | 0.05 | 1.41 | 110 | 0.06 | +0.26 |
| 7 | 0.04 | 1.43 | 105 | 0.06 | +0.20 |
| 8 | 0.05 | 1.42 | 173 | 0.07 | +0.06 |
| 9 | 0.05 | 1.50 | 123 | 0.06 | +0.15 |
| 10 | 0.04 | 1.49 | 128 | 0.06 | +0.13 |

γ = gradation between the densities 0.3 and 1.7
E = relative sensitivity, as measured at density D = 0.3 a doubling of E means a doubling of sensitivity The results show that, after storage in a heating cabinet, the fog level is considerably reduced where the chelate compounds according to the invention are used in the different quantities indicated.

The increase in sensitivity after storage in a heating cabinet is smaller, the higher the molar ratio of cobalt to penicillamine.

EXAMPLE 2

After addition of the triazaindolizine, quantities of 2 mg of penicillamine in the form of a 0.1% aqueous solution and, after stirring for 10 minutes at 40° C., quantities of 2,4,8 and 16 ml of the cobalt chelate compound 2.2 (diluted in a ratio of 1:100) are added to a silver halide emulsion corresponding to Example 1. For comparison, the emulsion is used without addition of the penicillamine and the cobalt chelate compound. The emulsion is further processed in accordance with Example 1. The results of the sensitometer test are shown in Table 2.

The results show that the combination of penicillamine with the cobalt chelate compound of penicillamine produces an additional increase in sensitivity despite a considerable reduction in the fog values and in the increase in sensitivity after storage in a heating cabinet.

TABLE 2

| Sample | mg of penicillamine/ mole of AgX | ml of Co-chelate compound 2.2 diluted 1:100/mole of AgX |
|---|---|---|
| 1 | 0 | 0 |
| 2 | 2 | 2 |
| 3 | 2 | 4 |
| 4 | 2 | 8 |
| 5 | 2 | 16 |

| | | | | 3 days in a heating cabinet at 60° C. | |
|---|---|---|---|---|---|
| Sample | Fog | E | γ | fog | log It |
| 1 | 0.05 | 100 | 1.76 | 0.10 | +0.27 |
| 2 | 0.05 | 135 | 1.87 | 0.08 | +0.15 |
| 3 | 0.05 | 128 | 1.86 | 0.07 | −0.13 |
| 4 | 0.05 | 120 | 1.89 | 0.06 | +0.14 |
| 5 | 0.04 | 117 | 1.91 | 0.07 | +0.15 |

E = relative sensitivity, as measured at a density D = 0.3; a doubling of E means a doubling of sensitivity
γ = gradation between the densities 0.3 and 1.7

I claim:

1. In a light sensitive photographic material having at least one light sensitive silver halide emulsion of improved stability comprising a support and on the support at least one photosensitive silver halide emulsion and having at least one layer containing a complex of cobalt with a compound, said complex being capable of stabilizing a photographic silver halide emulsion and maintaining the relative speed, wherein the improvement comprises the compound in said complex corresponds to the following formula:

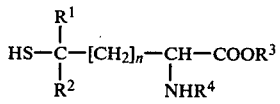

in which $R^1$ represents hydrogen or an alkyl, aryl, aralkyl or acyl group;

$R^2$ represents an alkyl, aryl, aralkyl or acyl group;

$R^3$ represents hydrogen or a cation, $R^4$ represents hydrogen or an alkyl or acyl group, n=0 or an integer, and/or $R^1$ and $R^2$ together represent the atoms required to complete a ring.

2. A process for producing a silver halide emulsion of improved stability by precipitating the silver halide in the presence of a protective colloid, wherein a cobalt complex with a compound corresponding to the following formula:

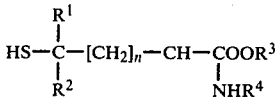

in which $R^1$ represents hydrogen or an alkyl, aryl, aralkyl or acyl group;

$R^2$ represents an alkyl, aryl, aralkyl or acyl group;

$R^3$ represents hydrogen or a cation;

$R^4$ represents hydrogen or an alkyl or acyl group;

n=0 or an integer, and/or $R^1$ and $R^2$ together represent the atoms required to complete a ring, is added to the emulsion whereby the density is stabilized for constant sensitivity.

3. A photographic material as claimed in claim 1, wherein the cobalt complex is contained in a silver halide emulsion layer.

4. An emulsion as claimed in claim 1, wherein the cobalt complex is present in a quantity of from 0.05 to 100 mg per mole of silver halide.

5. A material as claimed in claim 1, wherein

R represents hydrogen or an alkyl group containing from 1 to 4 carbon atoms;

$R^2$ represents an alkyl group containing from 1 to 4 carbon atoms;

$R^3$ represents hydrogen or a cation;

$R^4$ represents hydrogen and n=0, 1 or 2.

6. A material as claimed in claim 1, in which $R^1$ represents methyl;

$R^2$ represents methyl;

$R^3$ represents hydrogen;

$R^4$ represents hydrogen and n=0.

* * * * *